United States Patent [19]

Benedict

[11] 4,063,733

[45] Dec. 20, 1977

[54] GOLF CLUB

[76] Inventor: Mark C. Benedict, 158 Moseley Terrace, Glastonbury, Conn. 06033

[21] Appl. No.: 172,498

[22] Filed: Aug. 17, 1971

[51] Int. Cl.[2] ..... A63B 53/02

[52] U.S. Cl. ..... 273/80 C; 273/167 G

[58] Field of Search ..... 273/67 C, 77 R, 77 A, 273/80 R, 80 C, 83, 167–175, 164

[56] References Cited

U.S. PATENT DOCUMENTS

| | | | |
|---|---|---|---|
| 723,534 | 3/1903 | Knight | 273/167 F |
| 1,517,476 | 12/1924 | Tyler | 273/80 C UX |
| 1,631,504 | 6/1927 | Redman | 273/80 C |
| 1,901,562 | 3/1933 | Main | 273/169 |
| 3,037,770 | 6/1962 | Palmer | 273/80 C |
| 3,042,405 | 7/1962 | Solheim | 273/167 G X |
| 3,066,936 | 12/1962 | Hyde | 273/80 C |
| 3,191,936 | 6/1965 | Guier | 273/171 X |
| 3,305,235 | 2/1967 | Williams | 273/169 X |
| 3,319,962 | 5/1967 | Summers | 273/167 G X |
| 3,368,812 | 2/1968 | Baldwin | 273/173 X |
| 3,497,220 | 2/1970 | Scott | 273/80 C X |
| 3,516,674 | 6/1970 | Scarborough | 273/169 |
| 3,574,349 | 4/1971 | Kropp | 273/80 C X |
| 3,888,484 | 6/1975 | Zitko | 273/167 G X |
| 3,966,210 | 6/1976 | Rozmus | 273/167 G X |

OTHER PUBLICATIONS

*Physics for Science and Engineering Students,* W. H. Furry et al, Harvard University, Copyright 1952 by the Blakiston Company, pp. 45–51.

*Primary Examiner*—Richard J. Apley

[57] ABSTRACT

A golf club is presented wherein the point of attachment, or the effective point of attachment, of the shaft to the club head is offset forward of the center of gravity of the head. The offset is in an amount such that the force couple created by translational acceleration of the head during the forward part of the stroke of the club is approximately equal to the torque required to overcome and opposite to the rotational inertia of the head to turn the club face from an angular position of other than perpendicular to the path of travel of the center of gravity on the backstroke to an angular position at impact substantially perpendicular to the path of travel of the center of gravity.

8 Claims, 13 Drawing Figures

Inventor
Mark C. Benedict

By FISHMAN & VANKIRK
Attorneys

Inventor
Mark C. Benedict

By Fishman & VanKirk
Attorneys

GOLF CLUB

BACKGROUND OF THE INVENTION

1. Field of the Invention

This invention relates to the field of golf clubs. More particularly, this invention relates to golf clubs particularly designed and adapted to eliminate instability in swinging the club and to improve accuracy and repeatability in use of the club.

2. Description of the Prior Art

Designers and users of golf clubs have long addressed themselves to the problems of accuracy and repeatability of golf clubs, and many attempts have been made to incorporate special designs into golf clubs to improve the accuracy of these clubs. Different approaches to this problem have included designs to distribute the weight of the club in various ways with respect to the center of gravity or point of percussion (some times referred to as the "sweet spot") of the club. Designs have been suggested wherein the mass of the club head is concentrated at the center of gravity, and other designs have been suggested wherein the club head is weighted at the toe and heel sections to locate the major mass portions of the club away from the center of gravity. Designs have also been proposed for tailoring the weight distribution of the club in accordance with the particular needs or desires of the user. Typical examples of these prior art approaches may be seen in the patents to Hanbzlik, Jr. U.S. Pat. No. 2,991,082, Legh U.S. Pat. No. 1,139,985, MacIntrye U.S. Pat. No. 2,954,231 and MacIntrye U.S. Pat. No. 3,143,349. Particular attention has been given to this problem with respect to putters, and recently successful commercial putter designs employing weight distribution concepts are known in the art and to the trade as the "Bull's Eye" and the "Ping" putter instruments.

However, notwithstanding the various attempts and approaches of the prior art, inaccuracy and instability still occurs even when the sweet spot of the club contacts the ball, and to greater extent than anticipated when contact between the club and the ball is other than at the sweet spot.

SUMMARY OF THE INVENTION

The present invention results in a golf club of improved characteristics over those presently available in the art and results in a club having a higher inherent degree of stability than is found in prior art clubs. In accordance with the present invention, the improved golf club is realized by the configuration wherein the point of attachment, or the effective point of attachment, of the club shaft to the club head is located forward of the center of gravity of the club head (the club head including any shank connecting the head to the club shaft), i.e. between the center of gravity and the forward or toe portion of the club. It has been determined that a significant problem with prior art golf clubs has been an instability problem resulting from torque or moment of inertia effects generated during the swing of the club. Most known prior art clubs have been of the type where the point of attachment of the shaft is at or behind the center of gravity of the head, and the present inventor had determined that an inherent instability results from that configuration. It has been determined that the prior art design wherein the shaft is connected to the head at or behind the center of gravity of the head requires the golfer to apply a correcting torque during the swing of the club to return the club to the proper line of direction of travel at the point of impact with the ball, and the failure of the golfer to apply just the right amount of torque to the inherently unstable club results in severe inaccuracy of the golf shots.

The present invention overcomes the unstable characteristic of the prior art golf clubs by a configuration wherein the point of attachment, or the effectve point of attachment, of the shaft to the club head is forward of the center of gravity of the head. This configuration of the present invention results in an inherent corrective force or torque during the golf swing which tends to bring the club head back to the correct and desired alignment with respect to the ball. This inherent corrective action overcomes and eliminates the instability of the prior art golf clubs and results in an improved club having improved stability and accuracy over the prior art clubs for a normal stroke of any club; i.e., for a typical or normal stroke of any club where the club is started at an address position, is swung through a typical arc for that club in a regular swing plane and returned to the address position.

Accordingly, one object of the present invention is to provide a novel and improved golf club having a high degree of stability.

Still another object of the present invention is to provide a novel and improved golf club wherein unbalancing torque effects normally generated during the swinging of the club are automatically compensated.

Other objects and advantages will be apparent from the following detailed description and drawings.

BRIEF DESCRIPTION OF THE DRAWINGS

Referring to the drawings wherein like elements are numbered alike in the several figures.

DESCRIPTION OF THE PREFERRED EMBODIMENT

In the following description of the preferred embodiments, the present invention will be described as applied to a putter golf club being used by a right-handed golfer. However, it will be specifically understood that the invention is not limited to putters, but, rather, may be applied to any golf club in the entire spectrum of clubs.

Figures 1A, 1B, 1C:
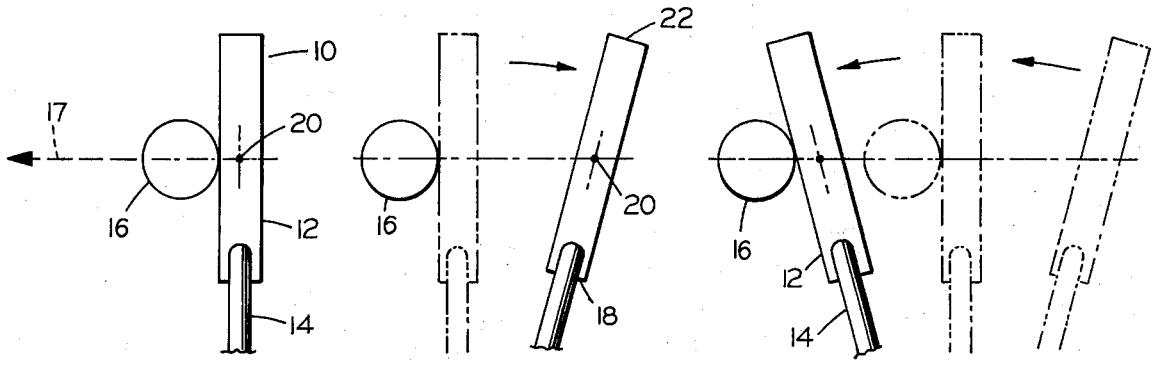
FIGS. 1A, 1B and 1C are diagramatic representations of a typical golf swing.

Referring first to several parts of FIG. 1, FIG. 1A shows a typical prior art golf club 10 having a head portion 12 and a shaft 14, the club being in the position of addressing a ball 16 in preparation for a stroke, particularly a putting stroke. Dashed line 17 shows the direction of desired travel of ball 16, and the head 12 of the club is placed behind the ball in the position to which the golfer hopes to return the club at the moment of impact. The following analysis will consider only motion of the putter head in the plane of the paper and will not take into consideration the curvilinear motion also resulting from a back swing; however, this simplified approximation still provides a valid consideration of all of the important factors of concern. As shown in FIG. 1B, the back swing from the initial address position of FIG. 1A results in club head rotation in the back stroke as well as translation. An effective putting stroke as shown in FIG. 1C requires that the club head on the forward part of the stroke be brought forward to contact ball 16 at precisely the address position of the club head with respect to the ball. Thus, the forward part of the stroke requires that the golfer impart the necessary force or torque to rotate the club head back to the desired position at the point of contact, and accurate and consistent stroking requires that the golfer supply all of the desired force and motion consistently at each stroke. Most known prior art golf clubs attach the shaft 14 to head 12 between the heel 18 of the club head and the center of gravity 20, or at the center of gravity in the case of the so called "center shafted" club. An inherently unstable state results from such attachment configurations because the inertial force moment from such configurations is a clockwise moment tending to keep the club head rotated clockwise with respect to the address position. Accordingly, in order to return the club head to the address position, the golfer must provide the desired counterclockwise torque by applying the proper torque to the shaft of the club with his hands. The right amount of torsion must be supplied by the golfer and at the right time in order to return the club to the correct impact position; and putting consistency requires accurate repetition of the torsion force and timing for each stroke; and the correct torsion force must be applied during the relatively short time span, on the order of a fraction of a second, of the forward part of the stroke. If the golfer does not supply enough torque, the club face arrives at the impact position in an "open" position with a resultant slice of the ball; conversely, if the golfer applies too much torque, the club face arrives at the impact position in a "closed" position with a resultant hook ball. All of these demands will result in considerable possibility for error and inconsistency in the golfer's swing.

It has been discovered that a significant part of the problem with previous golf clubs results from the fact that the inertia force couple due to club head rotation tends to keep the club head open in the forward stroke, i.e. a clockwise moment is imposed on the club head (assuming a right-handed swinger). Furthermore, the force couple created by accelerating the club head also results in a clockwise moment tending to keep the face of the club head open on the forward stroke when the shaft is connected between the center of gravity and the heel of the club. Either or both of these force couples, i.e. the inertia force couple or the acceleration force couple must be compensated with a correcting counterclockwise torque imparted by the golfer in order to return the club head to the address position, and it is this torque requirement imposed on the golfer which makes accuracy and repeatability of shots a most difficult achievement.

It has been discovered, and the present invention is based on that discovery, that the torque requirement normally imposed on the golfer can be significantly reduced or eliminated by placing the point of attachment of the club shaft forward of the center of gravity of the club head, i.e. between the center of gravity 20 and the toe 22 of the head of the club. The shaft is offset forward of the center of gravity in an amount such that the force couple created by accelerating the club head is approximately equal and opposite to the inertia force couple due to the club head rotation. In this way, the acceleration force couple will be counterclockwise and opposite to the inertia force couple due to club head rotation. The result is that the golfer has only to hold the club in the proper plane and accelerate it, and will not have to supply the torque required for previous clubs to return the club face to the correct position at impact. Thus, a self-restoring couple is built into the club to reduce or eliminate the need for the golfer to apply a restoring torque to the head of the club.

Reference to FIGS. 2A, 2B, 2C and 2D will illustrate the concept of the present invention with a simplified mathematical analysis. This analysis will be simplified in assuming only plane motion of the club head in the plane of the paper instead of curvilinear three-dimensional motion in space, but the proof is still valid. The mathematical model will analyze a putter and will assume a back stroke of one foot and a desired velocity at point of impact with the ball of 12 feet per second to approximate a 20 foot putt.

Figures 2A, 2B, 2D:
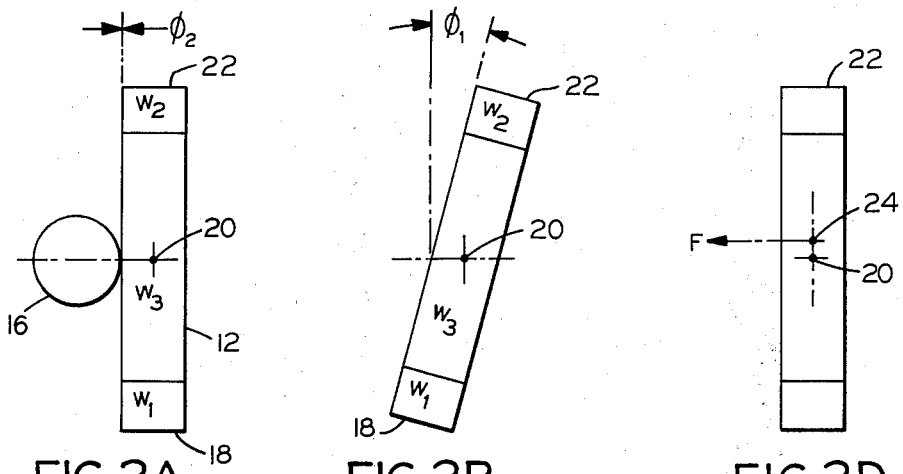
FIGS. 2A, 2B and 2C are diagramatic representations of a plan view of a golf club head with weight distribution.
FIG. 2D is a diagramatic representation of such golf club head with the point of attachment of the shaft offset in accordance with the present invention.
Figure 2C:
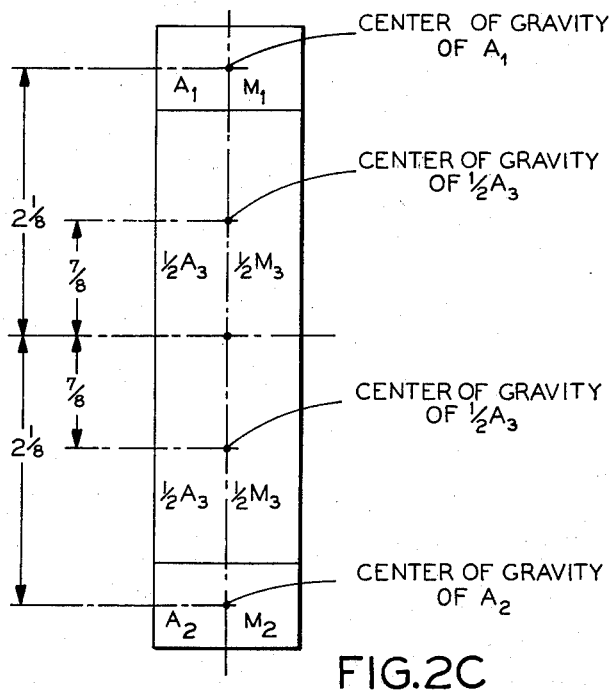

FIG. 2A shows a plan view of the putter head 12 at the position of address with respect to ball 16. The putter head is of the type wherein a weight $W_1$ is at heel 18 and a weight $W_2$ is at toe 22, and the portion between $W_1$ and $W_2$ is indicated at $W_3$. FIG. 2B shows the putter at the end of the back swing one foot from the address position and rotated at an angle $\Theta$ of 15°. The following conditions apply:

$W_1$ = 5 oz., $W_2$ = 5 oz., $W_3$ = 3 oz., $V_1$ (forward velocity at the end of the back stroke) = 0 feet per second, $\Theta_1$ (at the back stroke) = 15°, $V_2$ (forward velocity of the club head at the point of impact with the ball) = 12 feet per second, $\Theta_2$ (at impact) = 0°.

To strike the ball, the club head (weighing 13/16 pounds) must be accelerated from 0 to 12 feet per second velocity in one foot of travel. Assuming constant acceleration, it can be shown from the standard laws of motion that an acceleration of 72 feet/sec.$^2$ is required to produce the impact velocity $V_2$ of 12 feet per second, and the required time will be 1/6 of a second. From the general relationship of F = MA, it can also be shown that the force F to produce the required acceleration is 1.828 pounds.

While the putter head is moving the one foot from the end of the back swing as shown in FIG. 2B to the impact position shown in FIG. 2A, the putter head must be rotated 15° by some force. In all previous clubs, this force has been the result of a torque supplied by the golfer and transmitted in torsion through the shaft. The rotational counterpart of the second law of motion is $T = I\alpha$ or torque equals moment of inertia times angular acceleration. Applying the laws for rotational motion:

1. $W = W_0 + \alpha T$
2. $\Omega = W_0 T + \frac{1}{2}\alpha T^2$
3. $W^2 = W_0^2 + 2\alpha\Omega$ where W = angular velocity (radians per second), $\alpha$ equals angular acceleration (radians per second$^2$), T = time (seconds), and $\Omega$ = angle (radians)

it can then be shown that the angular acceleration $\alpha = 6\pi$ radians/second$^2$. Assuming that the club head has the physical dimensions shown in FIG. 2C, then it can be shown that the total amount of inertia of the club head is 0.00064 pound feet $^2$. Then, applying the relationship $T = I\alpha$, it can be shown that a torque of 0.0121 foot pounds is required to return the club head to the contact position shown in FIG. 2A. As shown in FIG. 2D, that torque is provided in the present invention by the self-restoring feature of attaching the club shaft to the club head and point 24 which is a distance of 0.079 inches from the center of gravity 20 toward toe 33 of the club head. The attachment of the shaft on the toe side of the center of gravity of the club head results in a self-restoring couple providing a counterclockwise moment tending to restore the club head to the desired impact position as shown in FIG. 2A.

Of course, it will be understood that the foregoing mathematical analysis has been directed merely to a model of a particular putter for purposes of illustration. The invention is in no way limited to the particular size and dimensions of the putter used in the model, nor is the invention limited only to putters. The essential concept of the invention is the location of the center line of the shaft, or the effective center line of the shaft, of the club forward of the center of gravity of the club head, i.e. between the center of gravity and the toe of the club. The concept is applicable to all clubs.

Figure 3:
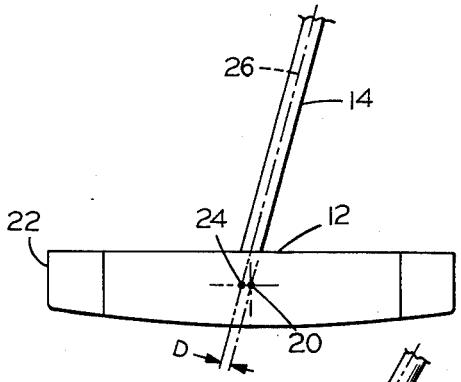
FIGS. 3, 4 and 5 show various configurations for off-setting the point of attachment or effective point of attachment of the shaft to the club head in accordance with the present invention.

Referring now to FIG. 3, the basic configuration is shown wherein shaft 14 is connected to club head 12 at a position such that the center line 26 of the shaft intersects the horizontal line or plane which includes the center of gravity 20 at point 24, point 24 being forward of the center of gravity, i.e. being between the center of gravity and toe 22 of the club with a resultant offset D between point 20 and point 24.

Figure 4:
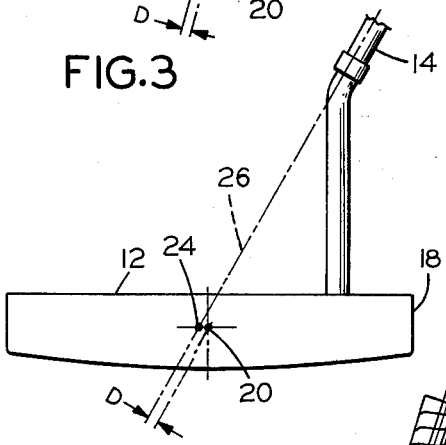

While the configuration shown in FIG. 3 shows an actual physical connection between shaft 14 and club head 12 forward of the center of gravity of the club head, the actual point of physical attachment of the shaft can, in accordance with the present invention, even be behind the center of gravity, i.e. between the center of gravity and the heel of the club, as long as the effective point of connection of the shaft to the club head is forward of the center of gravity. By "effective point of connection" is meant the point of intersection between the center line of the grip portion of the shaft and the horizontal line or plane including the center of gravity. Thus, as shown in FIG. 4, although shaft 14 is physically connected near heel 18 of club head 12, the effective point of connection is determined by extending the center line 26 of the grip portion of the shaft to intersect with the horizontal line or plane including the center of gravity 20, and it is seen that point of intersection 24 is still offset from and forward of the center of gravity by the distance D. The bend in shaft 14 which allows for the physical connection of the shaft near heel 20 is very low on the shaft, i.e. near the head end of the shaft.

Figure 5:
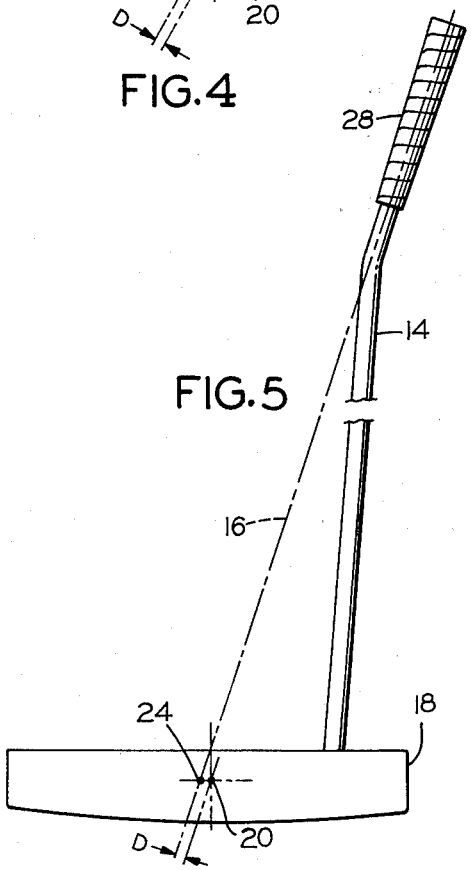

Another modification is shown in FIG. 5 wherein the bend in shaft 14 is near grip 26. The configuration of FIG. 5 also allows for the physical connection of shaft 14 near heel 18 while the extension of the center line 26 still passes through the point 24 forward of center of gravity 20 to provide the desired offset D forward of the center of gravity.

Figure 7:
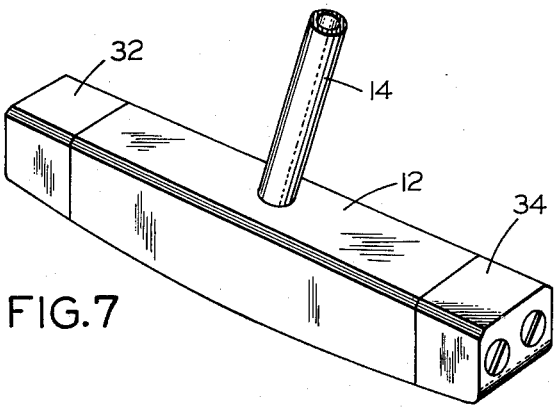
FIG. 7 is a perspective view of the club of FIG. 6A.
Figure 6A:
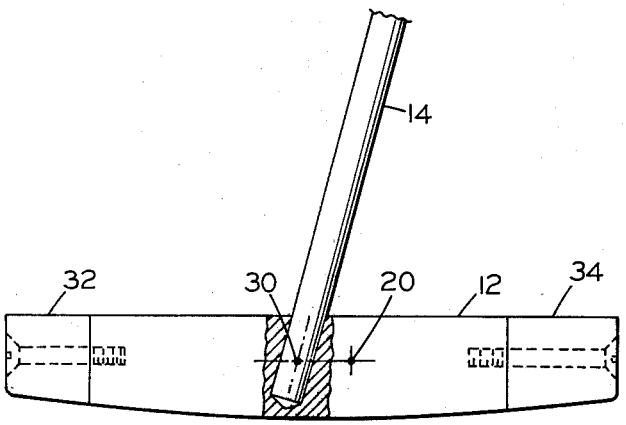
FIGS. 6A and 6B show embodiments of the present invention wherein the desired offset of the shaft with respect to the center of gravity is accomplished by weight distribution at the toe and heel of the club.

Referring now to FIGS. 6A and 7, still another embodiment is illustrated wherein club shaft 14, and the center line thereof, actually pass through the geometric center 30 of the club head. However, in the FIG. 6A embodiment, club head 12 is provided with a toe weight 32 and a heel weight 34, both of which are attached to the club head by suitable fastening elements. Heel weight 34 is heavier than toe weight 32, a result which may be achieved, for example, by the use of different materials for the two weights, and this difference in weight results in the location of the center of gravity 20 closer to heel 34 than toe 32. Thus, once again, the center line of shaft 14 is effectively connected forward of the center of gravity of the head, notwithstanding that the shaft actually passes through the geometric center.

Figure 6B:
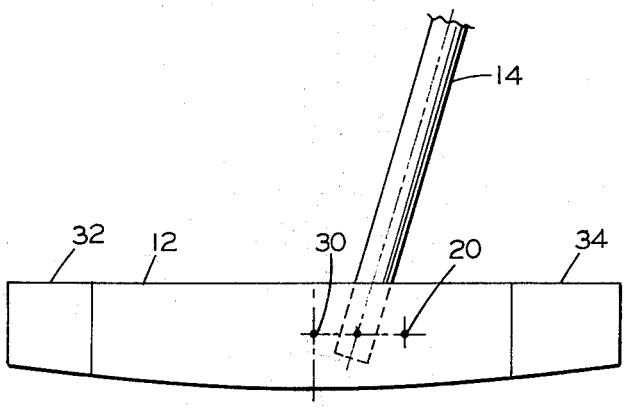

A slightly different arrangement is also shown in FIG. 6B wherein the weight distribution of the club is such that the center of gravity 20 is moved further back toward heel 34. In this arrangement the center line of shaft 14 is between geometric center 30 and center of gravity 20, but still forward of the center of gravity.

As can be seen from FIG. 7, as well as from the other figures of the drawings, the appearance of the golf club of the present invention can be and is essentially similar to the appearance of generally accepted present day golf clubs so that the important constructional aspect of the present invention does not in any way interfere with appearance and acceptability of the club.

A golf club configuration known in the art is the "offset" configuration wherein the main portion of the shaft is offset (i.e. displaced in a vertical plane) from the head of the club. The concept of the present invention still applies to this offset configuration, and the location of the effective center line of the shaft forward of the center of gravity of the head is determined by projection of each to a common plane.

While a preferred embodiment has been shown and described, various modifications and substitutions can be made thereto without departing from the spirit and scope of the present invention. Accordingly, this invention has been described by way of illustration and not limitation.

What is claimed is:

1. A golf club having:

a head having a center of gravity;

a toe portion and a heel portion on said head, said center of gravity being between said toe and said heel; and a shaft connected to said head, the effective location of connection of said shaft to said head being offset forward of said center of gravity of said head toward said toe and defining the point on said head at which the force generated by a golfer swinging the club in a normal stroke of the club is effectively applied, said offset toward said toe being in an amount such that the force couple created by translational acceleration of the head during the forward part of the stroke of the club is approximately equal to the torque required to overcome and opposite to the rotational inertia of said head to turn the face of said head from an angular position of other than perpendicular to the path of travel of said center of gravity on the backstroke to an angular position at impact substantially perpendicular to the path of travel of said center of gravity.

2. A golf club as in claim 1 wherein:

the actual location of connection of said shaft to said head coincides with said effective location of connection.

3. A golf club as in claim 1 wherein:

the actual location of connection of said shaft to said head is other than the effective point of connection.

4. A golf club as in claim 3 wherein:

said shaft has an axis, the effective location of connection of said shaft to said head being on said axis.

5. A golf club as in claim 1 wherein:

said shaft is actually connected to said head on the heel side of said center of gravity, said shaft having an axis passing forward of said center of gravity on the toe side thereof.

6. A golf club as in claim 1 wherein:

said toe portion and said heel portion are selectively weighted.

7. A golf club as in claim 6 wherein:

said toe portion and said heel portion are of different weights.

8. A golf club as in claim 7 wherein:

the actual location of said shaft to said head is at the geometric center of said head, said center of gravity being between said geometric center and said heel.

* * * * *